US005451193A

United States Patent [19]

Pickard

[11] Patent Number: 5,451,193

[45] Date of Patent: Sep. 19, 1995

[54] COMBINED WHEELCHAIR AND WALKER

[76] Inventor: Raleigh H. Pickard, P.O. Box 947, Penney Farms, Fla. 32079

[21] Appl. No.: 172,994

[22] Filed: Dec. 27, 1993

Related U.S. Application Data

[63] Continuation-in-part of Ser. No. 928,236, Aug. 12, 1992, abandoned.

[51] Int. Cl.[6] ..... A63B 22/20; A61H 3/04

[52] U.S. Cl. ..... 482/68; 280/250.1; 280/304.1

[58] Field of Search ..... 482/68, 67, 66; 188/9; 297/485, 5; 135/67; 280/250.1, 304.1

[56] References Cited

U.S. PATENT DOCUMENTS

| | | | |
|---|---|---|---|
| D. 158,041 | 4/1950 | Berger | D12/129 |
| 1,449,255 | 3/1923 | Abrahams et al. | D12/129 |
| 4,089,543 | 5/1978 | Osborne | 280/650 |
| 4,277,100 | 7/1981 | Beougher | 482/68 |
| 4,813,664 | 3/1989 | Vroulis | 482/68 |
| 5,046,748 | 9/1991 | Oat-Judge | 482/68 |
| 5,224,721 | 7/1993 | Santmann | 482/68 |

*Primary Examiner*—Stephen R. Crow
*Attorney, Agent, or Firm*—Shlesinger, Arkwright & Garvey

[57] ABSTRACT

Combined wheelchair and walker includes a frame, a seat attached to the frame, and a number of wheels rotatably attached to the frame. A braking device is provided that is operatively associated with the seat. The braking devices includes a first, braking state, and a second, non-braking state, the first state being a state in which the braking device restricts movement of one of the wheels when a force is applied to the seat, and the second, non-braking state is a state in which the braking device allows movement of the wheels when no force is applied to the seat. In another embodiment of the wheelchair walker combination, a brake is provided that the user actuates at will, whether seated using the device in its wheelchair mode or standing, using the device in its walker mode.

10 Claims, 3 Drawing Sheets

COMBINED WHEELCHAIR AND WALKER

CROSS-REFERENCE TO RELATED APPLICATION

This application is a continuation-in-part of application Ser. No. 07/928,236, filed Aug. 12 1992, now abandoned which is incorporated herein by reference.

FIELD OF THE INVENTION

The present invention relates to a device for encouraging wheelchair users to exercise. More specifically, the present invention is directed to a combined wheelchair and walker.

BACKGROUND OF THE INVENTION

Traditional wheelchairs allow and, indeed, encourage users to passively sit and avoid using their muscles.

Traditional walkers assist users who have difficulty in walking without a cane, or other device, or unassisted by others. Yet, such traditional walkers have no seats associated therewith whereby a user can sit at will. Thus, the user of a traditional walker is limited to walking and exercising in areas dependent on the seating available should the user desire or be required to sit while walking around.

Thus, both traditional wheelchairs and conventional walkers inherently discourage their respective users from exercising.

OBJECTS AND SUMMARY OF THE INVENTION

Accordingly, it is an object of the invention to provide a wheelchair which overcomes the drawbacks of known wheelchairs.

It is a further object of the invention to provide a walker which overcomes the drawbacks of existing walkers.

It is another object of the invention to provide a combined wheelchair and walker which overcomes the many drawbacks of conventional devices.

It is a still further object of the invention to provide a device which encourages traditional wheelchair and/or walker users to exercise more frequently.

It is yet another object of the invention to provide a wheelchair and/or walker which, in effect, forces users to exercise.

It is a still further object of the invention to provide a wheelchair and/or walker which is easier to use than conventional devices.

It is a further object of the invention to provide a combined wheelchair and walker which is more cost effective to use than traditional wheelchairs and walkers.

It is another object of the invention to provide a combined wheelchair and walker which provides better and more varied exercise to users than conventional wheelchairs and walkers.

It is a yet still further object of the invention to provide a combined wheelchair and walker which is more stable than conventional devices.

It is a further object of the invention to provide a combined wheelchair and walker which can be used indoors as well as outdoors.

In summary, the present invention provides a combined wheelchair and walker which achieves these and other objects.

A preferred embodiment of the invention provides a device having a frame, a seat attached to the frame, and a plurality of wheels rotatably attached to the frame. A braking device is operatively associated with the seat. The braking device includes a first, braking state and a second, non-braking state, the first state being a state in which the braking device hinders movement of one of the wheels when a force is applied to the seat, and the second, non-braking state being a state in which the braking device allows movement of the wheels when no force is applied to the seat.

Another preferred embodiment of the invention is a device having a frame, a seat attached to the frame, and wheels rotatably attached to the frame. The seat is movably attached to the frame for movement between a seating position in which a user can sit on the seat and a non-seating position in which a user can stand adjacent to the seat.

It is to be understood that throughout the specification the terms "wheelchair" and "walker" are to be understood as broad terms falling within the scope of the device according to my invention. When my invention is in its sitting mode it will have some features in common with tradition wheelchairs, and when my invention is in its walker or walking mode it will have features in common with a traditional walker.

The above and other objects and advantages and novel features of the present invention will become apparent from the following detailed description of the preferred embodiments of the invention illustrated in the accompanying drawings.

DETAILED DESCRIPTION OF THE INVENTION

Figure 1:
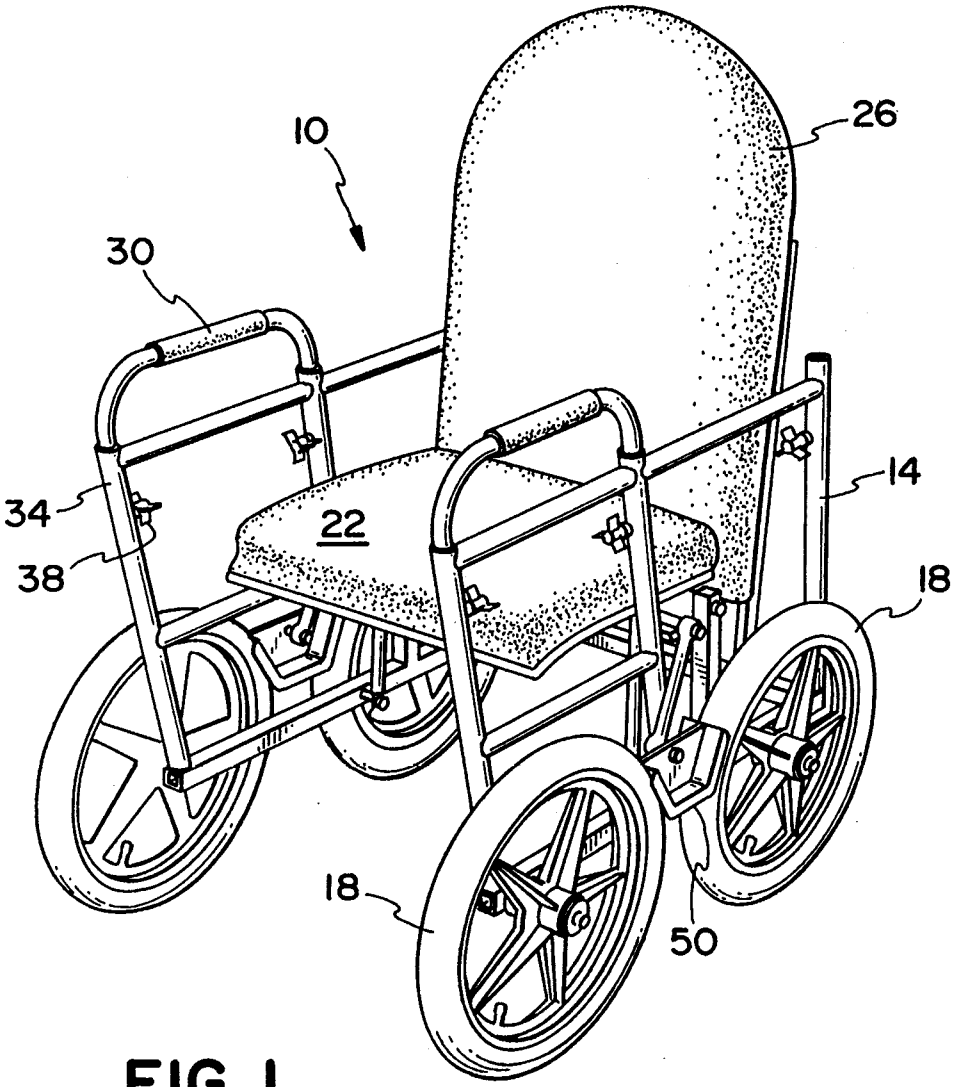
FIG. 1 is a perspective view of a combined wheelchair and walker according to the invention.
Figure 2:
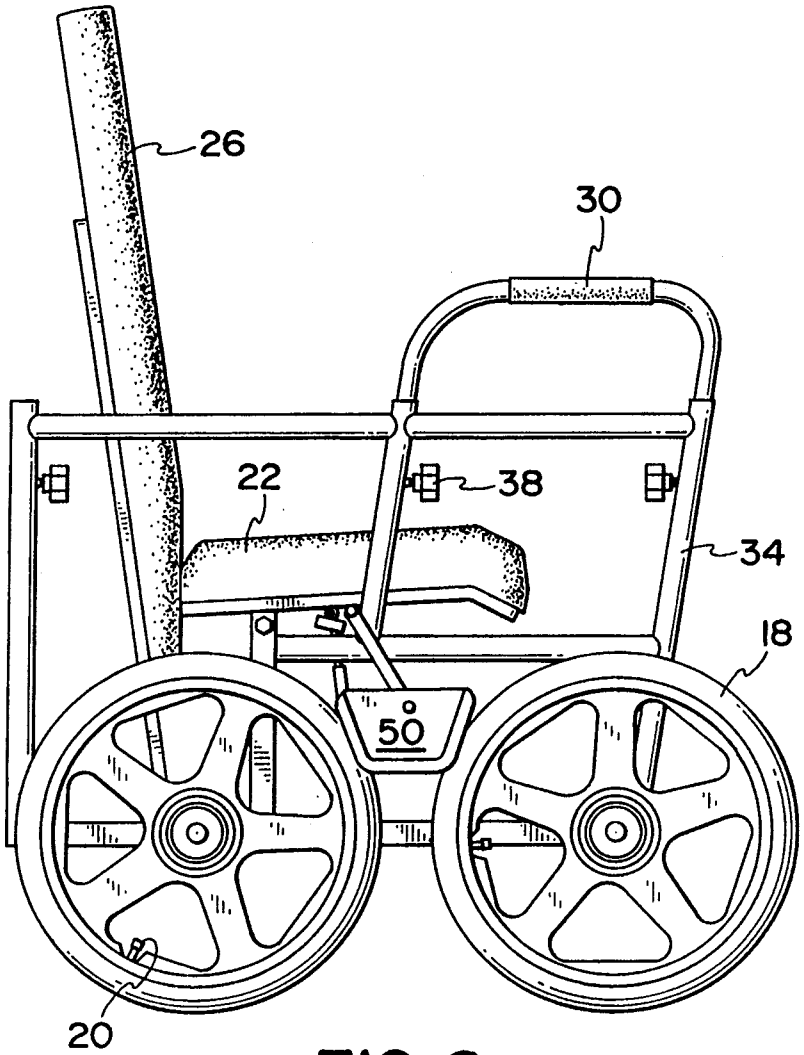
FIG. 2 is a side view of the preferred embodiment of FIG. 1, showing a seat in its lowered position with the brake engaged.

FIGS. 1–4 show a combined wheelchair and walker 10 according to a preferred embodiment of the invention, as shown in FIGS. 1 and 2 in its wheelchair mode.

This embodiment of the invention includes a frame 14 to which a number of wheels 18 are rotatably attached. Good results have been achieved when wheels 18 were made as pneumatic tires inflatable to different pressures, the pressure of which is adjustable by a valve stem 20. It is generally expected that wheels 18 will rotate relative to frame 14, and will not swivel, unlike many traditional wheelchairs having at least one forward set of swiveling wheels. It is contemplated that there will be applications for swiveling wheels in different embodiments of the invention, as will be appreciated from a complete reading of the description.

A seat 22 is pivotably attached to frame 14 and is shown in FIGS. 1 and 2 in a somewhat horizontal, "use" or seating position. The user, whose weight will maintain the seat in this position in this embodiment of the invention, is not shown sitting on seat 22 for clarity.

A seat back 26 is likewise attached to frame 14, along with arm rests 30. Uprights 34 are movable relative to the remainder of frame 14 thanks to the provision of adjustment knobs 38. Thus, the height of arm rests 30 relative to seat 22 is variable.

A brake shoe 50 engages one or more of wheels 18 for hindering movement of wheelchair 10 by restricting rotation of wheels 18 relative to frame 14. A brake arm 54 extends between seat 22 and brake shoe 50. Brake arm 54 may be pivotably attached to both seat 22 and brake shoe 50.

Figure 4:
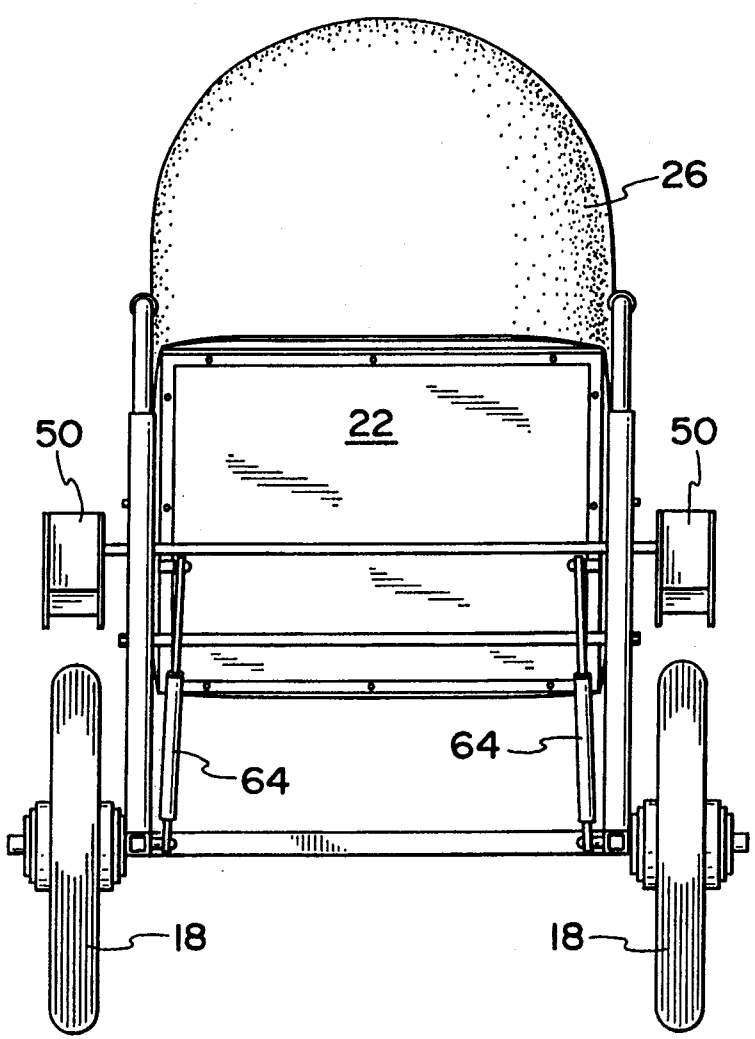
FIG. 4 is a rear view of the preferred embodiment of FIG. 1.
Figure 3:
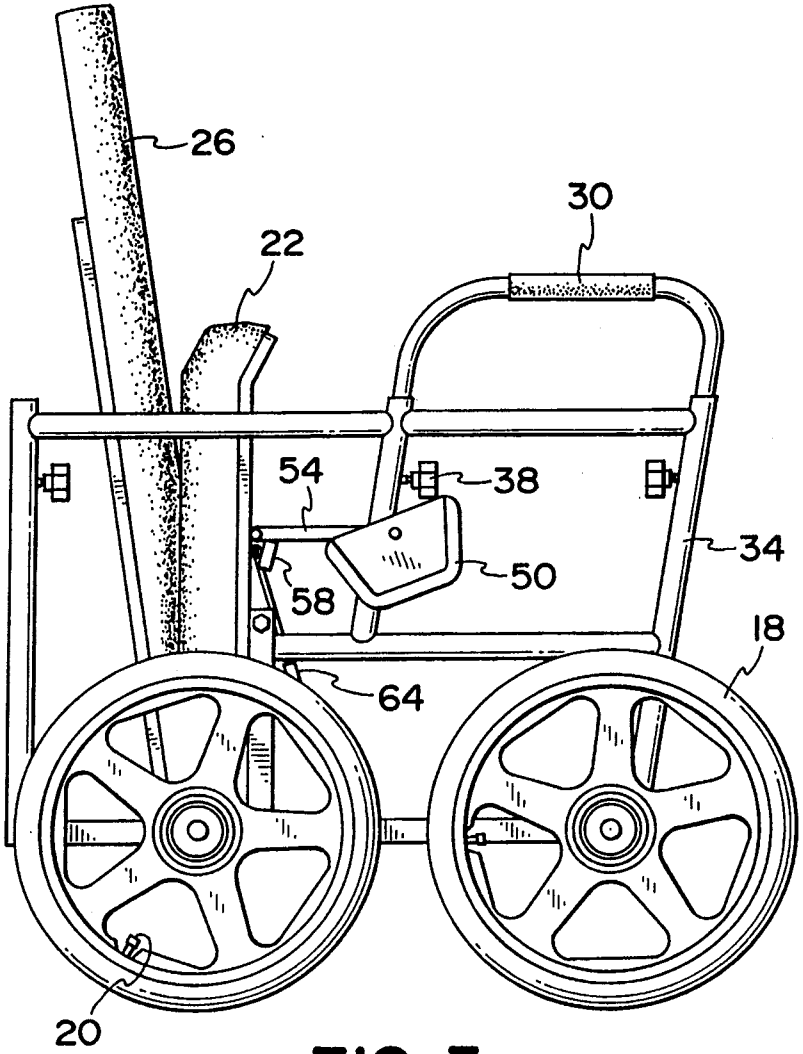
FIG. 3 is a side view of the preferred embodiment as shown in FIG. 2, illustrating the non-use position of the seat, with the brake disengaged.

FIGS. 3 and 4 illustrate the "walker" mode of the preferred embodiment of FIG. 1.

When wheelchair 10 is ready to be used as a walker, seat 22 is in a raised position, and brake shoe 50 is distant from and disengaged from wheels 18.

A stop 58 is provided for preventing engagement of brake 50 with wheel 18 when seat 22 is in its raised, walker mode. By adjusting the lengths and geometries of brake shoe 50 and brake arm 54, for example, the pivotable attachments between one or all of the components of the braking device can be fabricated as fixed attachments, and stop 50 can be eliminated, as will be readily appreciated.

Good results have been achieved with the illustrated embodiment of the pivotably attached brake shoe 50 and brake arm 54, as brake shoe 50 engages wheels 18 during repeated use.

A spring 64, which may be provided on both sides of wheelchair 10, assists in raising seat 22 when the user stands.

FIG. 5

Figure 5:
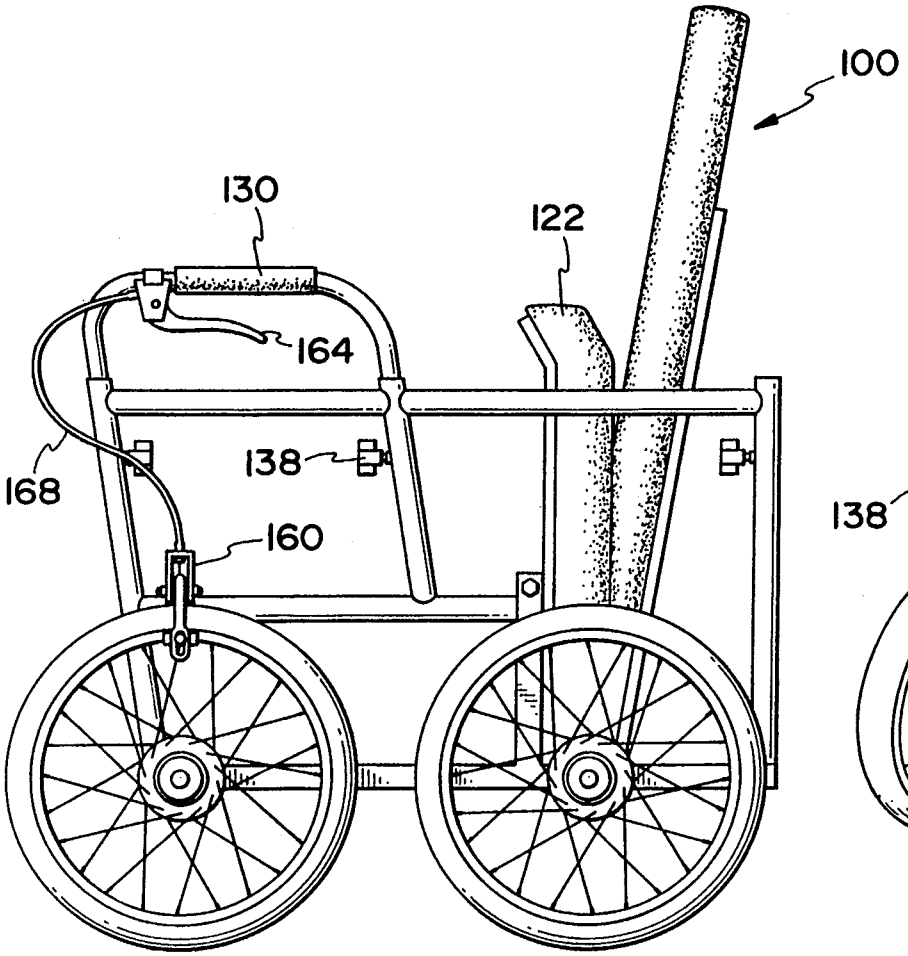
FIG. 5 is a side view of another preferred embodiment of the combined wheelchair and walker according to the invention.

The preferred embodiment of FIG. 5 includes a wheelchair 100 having a seat 122 pivotably attached thereto.

Unlike the embodiment of FIGS. 1–4, a brake shoe is not normally engaged when a user is seated on seat 122. Rather, a brake 160 is provided for restricting movement of one or more wheels 118 when actuated by the user.

Brake 160 includes a brake handle 164 which operates brake 160 by means of an actuator cable 168.

It is preferred that brake handle 164 be located near arm rest 130. Adjustment of the height of arm rest 130 relative to seat 122 is carried out by turning adjustment knobs 138. Accordingly, it is preferred that actuator cable 168 be sufficiently long to accommodate a full range of height adjustments for arm rest 130.

FIG. 6

Figure 6:
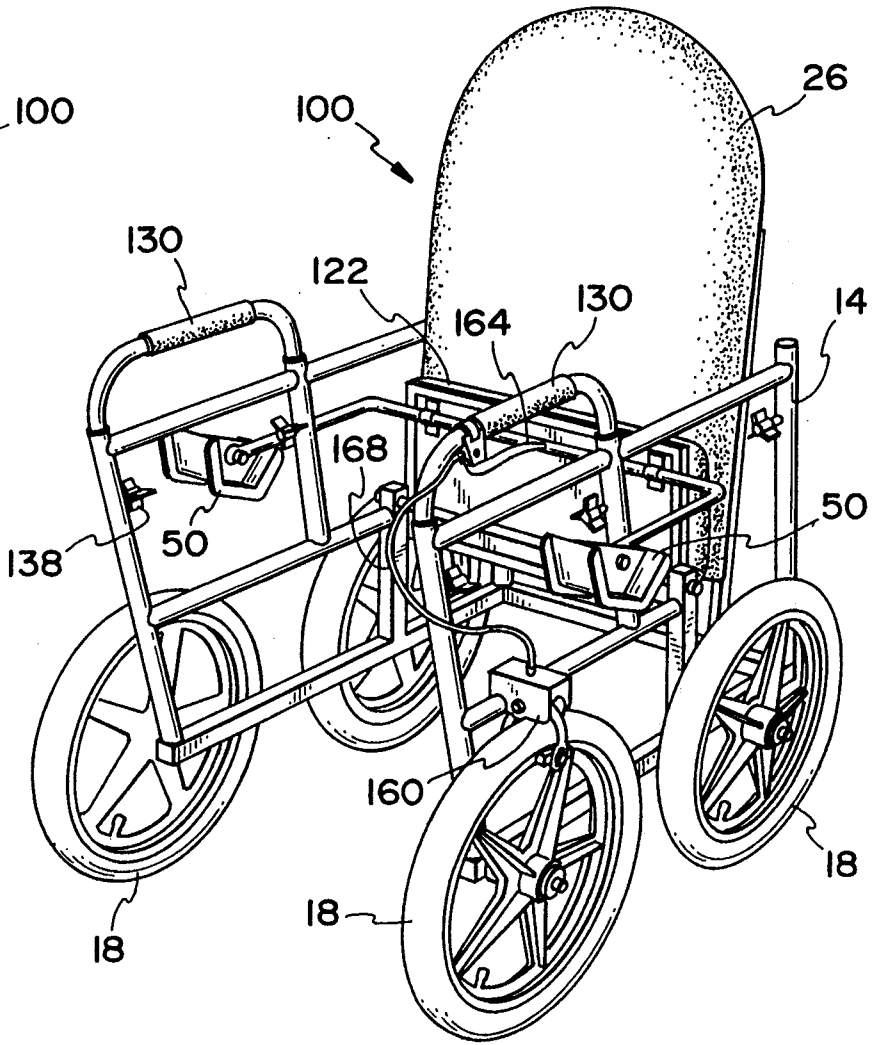
FIG. 6 is a perspective view of a combined wheelchair and walker according to the invention.

The preferred embodiment of FIG. 6 unlike FIG. 5 provides both brake 50 and brake 160.

OPERATION

In use, the operation of wheelchair 10 of the preferred embodiment of FIGS. 1–4 will be appreciated by first considering FIGS. 3 and 4, which illustrate the walker mode of the invention.

The walker mode is also typically the resting or non-use mode of the invention. Thus, when the user approaches wheelchair 10, seat 22 will typically be in its somewhat upright, raised position, as best seen in FIG. 3. Likewise, brake shoe 50 will be disengaged from wheels 18.

The user approaches wheelchair 10, shown in its walker mode of FIG. 3, stands substantially within the area defined by frame 14, and turns his or her back to seat back 26. The user grasps, or has already grasped, arm rests 30 with her hands. The user continues to hold arm rests 30 and walks forward in the manner of walking away from seat back 26. When the user wants to change direction the user bends her arms thereby pulling up on arm rests 30, and raises forwardmost wheels 18 slightly off the ground. The user then turns wheelchair 10 in the desired direction, much of the weight of wheelchair 10 being carried by the rear wheels 18 which are still engaging the ground.

After the user has exercised sufficiently or reached the desired location with wheelchair 10, and wishes to sit for a period of time, the user turns wheelchair 10 from its walker mode into its wheelchair mode as follows.

The user typically has his or her back facing seat back 26 as the user pushes downwardly on seat 22, thereby rotating seat 22 clockwise as viewed in FIG. 3, to convert wheelchair 10 from its walker mode to its wheelchair mode. As seat 22 is rotated sufficiently downwardly, brake shoe 50 engages wheels 18 and prevents movement thereof. The user will then sit in wheelchair 10 in the wheelchair mode of FIGS. 1 and 2.

The embodiment of FIG. 5 includes, among other things, the feature that brake 160 is not always engaged when the user is seated on seat 122. There are situations where a standing user would like the capability of applying brake 160 when standing and wheelchair 100 is in its walker mode. For example, it is contemplated that when the user is standing on an incline, and maintaining or regaining his or her balance, for example, the user will pull brake handle 164 and actuate brake 160 for stopping one or more wheels 118.

The embodiment of FIG. 5 is also useful for situations, such as when the user wants to roll down a slight incline, and wishes to sit on seat 122 in the wheelchair mode with a disengaged brake 160.

The combination wheelchair and walker according to the invention has been successfully built of strong, lightweight materials having a total weight of about 53 pounds. In that constructed embodiment the wheelchair had a length of about 33.5 inches, a width of about 28 inches, and a height of about 36.6 inches. The basic frame was fabricated using thin wall seamless tubing of the 4130 chromemoly type. The joints were heli-arc welded, and assembled joints were made using stainless steel bolts, nuts, and lock washers. Suitable plastic plugs were provided on open ends of the tubing. The completed assembly was finished with a non-toxic enamel. The seat, seat back, and soft trim components were made of a fire-resistent vinyl plastic. It is contemplated that various seatbelt and harness mechanisms be provided, such as with a ratchet mechanism for allowing a person to stand with the belt/harness still attached.

It is likewise contemplated that typical wheelchair footplates will be provided for use under certain circumstances, depending on expected end-use. For example, in an emergency situation one would fold down the typical foot plates, place the user's feet on the foot plate and pull the seated user backwards by pulling on the seat back.

It is also expected that the combination wheelchair and walker according to the invention will be constructed so that parts of the frame will be folded up or disconnected, as required, whereby the wheelchair will have an even more compact form for being transported, as in the user's automobile.

Various sizes and types of wheels, as well as other materials and components are contemplated.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A device comprising:

a) a frame;

b) a seat attached to said frame;

c) a plurality of wheels rotatably attached to said frame;

d) a braking device operatively associated with said seat; and e) said braking device including a first, braking state and a second, non-braking state, said first state being a state in which said braking device hinders movement of at least one of said plurality of wheels when a force is applied to said seat, and said second, non-braking state being a state in which said braking device substantially allows movement of said plurality of wheels when substantially no force is applied to said seat.

2. A device as defined in claim 1, wherein:

a) said seat is movably attached to said frame for movement between a seating position in which a user can sit on said seat and a non-seating position in which a user can stand adjacent to said seat.

3. A device as defined in claim 2, wherein:

a) said braking device includes a brake configured for engaging a portion of one of said plurality of wheels.

4. A device as defined in claim 3, wherein:

a) said braking device includes a brake shoe configured for engaging at least one of said plurality of wheels.

5. A device as defined in claim 2, wherein:

a) said braking device includes a brake shoe configured for engaging at least one of said plurality of wheels.

6. A device as defined in claim 1, wherein:

a) said braking device includes a brake shoe configured for engaging at least one of said plurality of wheels.

7. A device as defined in claim 1, wherein:

a) said braking device includes a brake configured for engaging a portion of one of said plurality of wheels.

8. A device as defined in claim 1, wherein:

a) an auxiliary brake is operatively associated with at least one of said plurality of wheels for hindering movement thereof.

9. A device as defined in claim 8, wherein:

a) said auxiliary brake is operable when said braking device is in its second, non-braking state.

10. A device as defined in claim 1, wherein:

a) an arm rest is disposed on said frame; and b) said arm rest is configured for being grasped by a user when a user stands adjacent said frame.

* * * * *